US006684606B1

(12) United States Patent
Draghetti

(10) Patent No.: US 6,684,606 B1
(45) Date of Patent: Feb. 3, 2004

(54) METHOD AND APPARATUS FOR MANUFACTURING SEALED PACKETS OF CIGARETTES

(75) Inventor: Fiorenzo Draghetti, Medicina (IT)

(73) Assignee: G.D. S.p.A., Bologna (IT)

( * ) Notice: Subject to any disclaimer, the term of this patent is extended or adjusted under 35 U.S.C. 154(b) by 0 days.

(21) Appl. No.: 09/601,409

(22) PCT Filed: Nov. 30, 1999

(86) PCT No.: PCT/IB99/01904

§ 371 (c)(1),
(2), (4) Date: Aug. 1, 2000

(87) PCT Pub. No.: WO00/35756

PCT Pub. Date: Jun. 22, 2000

(30) Foreign Application Priority Data

Dec. 15, 1998 (IT) ..... BO98A0693

(51) Int. Cl.[7] ..... B65B 61/20

(52) U.S. Cl. ..... 53/415; 53/136.1; 53/234; 53/449; 53/466

(58) Field of Search ..... 53/415, 466, 449, 53/136.1, 136.3, 136.4, 234, 173, 389.1; 156/517, 352, 353; 206/232, 264

(56) References Cited

U.S. PATENT DOCUMENTS 3,695,422 A * 10/1972 Tripodi ..... 206/232
4,354,894 A * 10/1982 Lewis et al. ..... 156/517
4,883,163 A * 11/1989 Gamberini et al. ..... 53/234
5,203,953 A * 4/1993 Focke et al. ..... 156/353
5,497,598 A * 3/1996 Boldrini ..... 53/234
5,607,526 A * 3/1997 Buckley ..... 156/352
5,931,292 A * 8/1999 Focke et al. ..... 206/264

FOREIGN PATENT DOCUMENTS

| | | |
|---|---|---|
| EP | 0 034 790 | 9/1981 |
| EP | 0 218 925 | 4/1987 |
| EP | 0 444 547 | 9/1991 |
| FR | 2 583 380 | 12/1986 |
| GB | 2 116 516 | 9/1983 |
| GB | 2 181 401 | 4/1987 |
| GB | 2 223 734 | 4/1990 |
| GB | 2 238 770 | 6/1991 |

* cited by examiner

*Primary Examiner*—Rinaldi I. Rada
*Assistant Examiner*—Thanh Truong
(74) *Attorney, Agent, or Firm*—Davidson Berquist Klima & Jackson, LLP

(57) ABSTRACT

In method of manufacturing sealed packets (102) of cigarettes, each displaying a revenue stamp (3) and a coupon (4) affixed to the printed faces, the packets (2*a*) emerge from a packaging machine (5) with the external paper or cardboard surface (10) still to be overwrapped and are conveyed singly and in succession from the packaging machine (5) to a cellophaner (6), through the agency of a transfer unit (107), following a path equipped with stations at which a revenue stamp (3) and a coupon (4) are applied to the outer surface (10) of each one; on reaching cellophaner (6), each packet (2*a*) is enveloped in a relative sheet (15) of transparent overwrapping material, and the folds of the sheet are secured to complete the sealed packet (102) of cigarettes.

16 Claims, 5 Drawing Sheets

METHOD AND APPARATUS FOR MANUFACTURING SEALED PACKETS OF CIGARETTES

This application is the international application PCT/IB99/01904 filed Nov. 30, 1999 which designate the U.S.

TECHNICAL FIELD

The present invention relates to a method of manufacturing packets of cigarettes.

In particular, the invention relates to a method of manufacturing sealed packets of cigarettes.

Generally considered, a packet of cigarettes consists in an ordered group of cigarettes enveloped by a first sheet of pliable wrapping material, normally metal foil paper, and, in the case of the soft type packet, a second sheet of pliable wrapping material wrapped around the first sheet. Alternatively, the second sheet of wrapping material may consist in a diecut blank of card or paperboard material folded around the first sheet in such a way as to fashion a packet of the rigid type with a hinged lid. The packet of cigarettes thus assembled, whether of the soft type or the rigid type having a hinged lid, is enveloped further in a protective overwrapping of transparent plastic film material, most typically polypropylene, folded and heat-sealed in such a way as to create a substantially airtight enclosure.

BACKGROUND ART

The systems employed in manufacturing packets of cigarettes include packaging machines equipped with infeed stations supplying the wrapping materials and stations at which the wrappings materials are folded around the successive groups of cigarettes, also cellophaners equipped with infeed stations supplying the sheets of transparent overwrapping material, stations at which the sheets are folded around the packets and stations at which the folded overwrapping sheets are heat-sealed.

In addition to the operations described thus far, it is the practice in certain countries to affix a revenue stamp to each packet before the sheet of overwrapping material is applied. The revenue stamp indicates that an excise duty is payable on the contents of the packet in the country of sale, and remains visible through the sheet of transparent overwrapping material.

It is also customary in some countries for each packet to be accompanied by a coupon, typically a slip or a fan-folded leaf of paper bearing printed matter such as advertising messages or collectable figures. Such coupons are placed normally between the first sheet of wrapping material and the second sheet or blank. The practice of placing the coupon directly in contact with the first wrapping sheet has proved to be deleterious in that the aroma of the tobacco tends to be adulterated by odours from the inks used in printing the coupons.

Moreover, the systems used to manufacture packets with both revenue stamps and coupons are relatively complex inasmuch as provision must be made for a coupon dispensing station between the stations at which the first and second wrappings are applied. With the introduction of devices for application of the coupon, the aforementioned packaging machines become more complicated, the wrapping operations are slowed down, and the hourly output capacity of the system as a whole is consequently reduced.

The object of the present invention is to provide a method for manufacturing sealed packets of cigarettes with revenue stamps and coupons that will be unaffected by the drawbacks described above.

In particular, the object of the invention is to provide a method for manufacturing sealed packets of cigarettes, each with a revenue stamp and a coupon, such as can be implemented employing systems of notably simple design and high output capacity.

DISCLOSURE OF THE INVENTION

A method for manufacturing sealed packets of cigarettes with revenue stamps and coupons, according to the present invention, comprises the steps of fashioning packets of cigarettes, in a packaging machine, each delimited by an outer surface that consists of a wrapping material; conveying the packets of cigarettes from the packaging machine to a cellophaner through the agency of transfer means; enveloping each packet of cigarettes in a transparent overwrapping material and securing the material to complete the sealed packet, and the further steps of applying a respective revenue stamp and applying a respective coupon to the outer surface of each packet during the step of conveying the packets of cigarettes from the packaging machine to the cellophaner.

The present invention also relates to a system for the manufacture of sealed packets.

A system according to the present invention for manufacturing sealed packets of cigarettes with revenue stamps and coupons is of the type comprising a packaging machine, on which to fashion packets of cigarettes delimited by an outer surface consisting of a wrapping material; a cellophaner, by which a transparent overwrapping material is folded around each packet of cigarettes and secured in such a way as to complete the sealed packet; transfer means, by which the packets of cigarettes are conveyed from the packaging machine to the cellophaner; also a device by which revenue stamps are applied to the packets of cigarettes; and a device by which coupons are applied to the packets of cigarettes, wherein the devices for applying the revenue stamps and applying the coupons are located along the transfer means.

The invention will now be described in detail, by way of example, with the aid of the accompanying drawings, in which:

FIG. 1 illustrates a system for implementation of the manufacturing method according to the present invention, viewed schematically in a side elevation with parts omitted for clarity;

FIGS. 2*a* and 2*b* are two different perspective views of a packet of cigarettes manufactured employing the system of FIG. 1;

Figure 1:
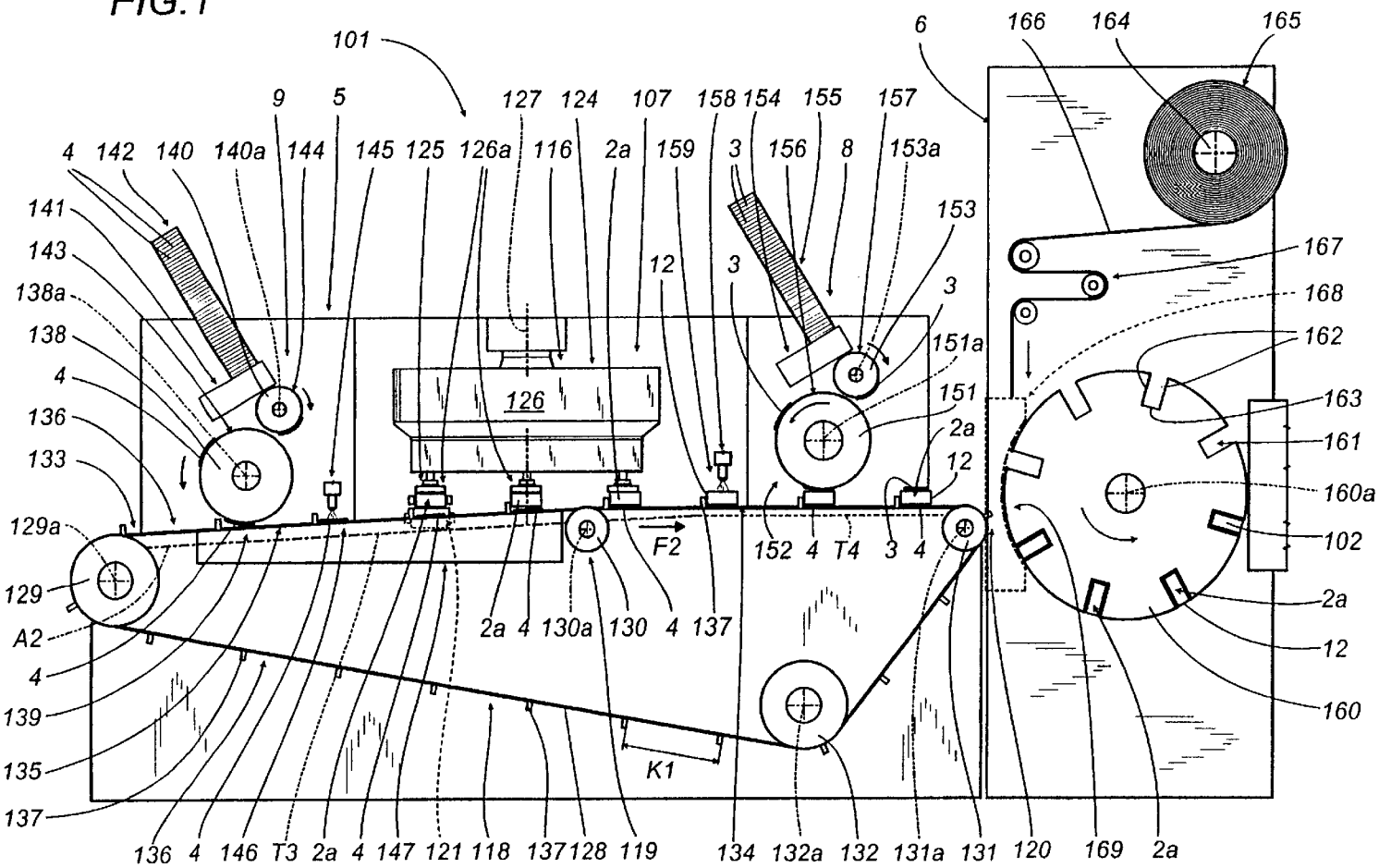

In FIG. 1 of the drawings, 101 denotes a system, in its entirety, for manufacturing sealed packets of cigarettes each within a respective revenue stamp 3 and respective coupon 4 or advertising leaflet.

The system 101 comprises a packaging machine 5 and a cellophaner 6 interconnected by way of a transfer unit 107, and, installed along the transfer unit, a device 8 for applying the stamps 3 and a device 9 for applying the coupons 4.

Figure 2A:
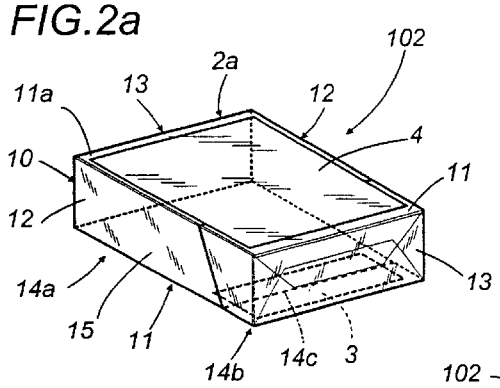
Figure 2B:
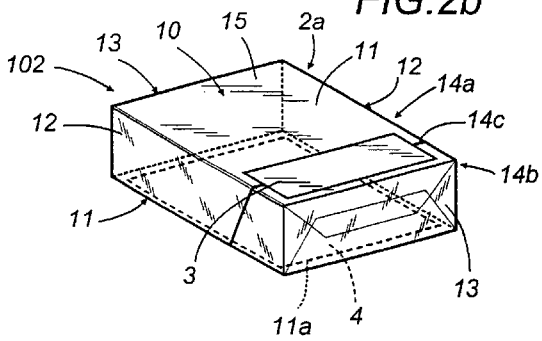

As discernible from FIGS. 2*a* and 2*b*, each sealed packet 102 of cigarettes comprises a packet proper, denoted 2*a*, which appears parallelepiped in shape and is delimited by an outer surface 10 consisting of an opaque wrapping material. More exactly, the outer surface 10 presents two mutually opposed and parallel main faces 11, two mutually opposed and parallel flank faces 12, and two mutually opposed and parallel end faces 13.

The packet 2*a* illustrated is of the rigid type with a hinged lid, comprising a container 14*a* and a lid 14*b*, both of cupped embodiment, which are connected together pivotably and rotatable thus one relative to another between a position (not illustrated) in which the packet 2*a* is open and a position in which the packet is closed (as in FIGS. 2*a* and 2*b*). More precisely, the container 14*a* and lid 14*b* are joined along a hinge crease 14*c* extending across the rear main face 11 near to one of the two end faces 13 and orthogonally to the two flank faces 12.

The single revenue stamp 3 appears rectangular and is affixed to the respective packet 2*a* with the two longer edges disposed parallel to and substantially equidistant from the hinge 14*c*.

The single coupon 4 also presents a substantially rectangular appearance and is applied to the front main face 11 of the respective packet 2*a*, i.e. to the main face 11 remote from the face 11 occupied by the revenue stamp 3. In particular, the coupon 4 is positioned on the front main face 11 with its endmost edges parallel to the corresponding endmost edges of the face 11. The transverse dimensions of the single coupon 4 are substantially the same as the transverse dimensions of the face 11 so that the face remains concealed, apart from a peripheral portion 11*a* of predetermined width.

Finally, each sealed packet 102 of cigarettes also comprises a sheet 15 of transparent overwrapping material which envelops the packet 2*a* and clings to the surface 10, the stamp 3 and the coupon 4.

Figure 3:
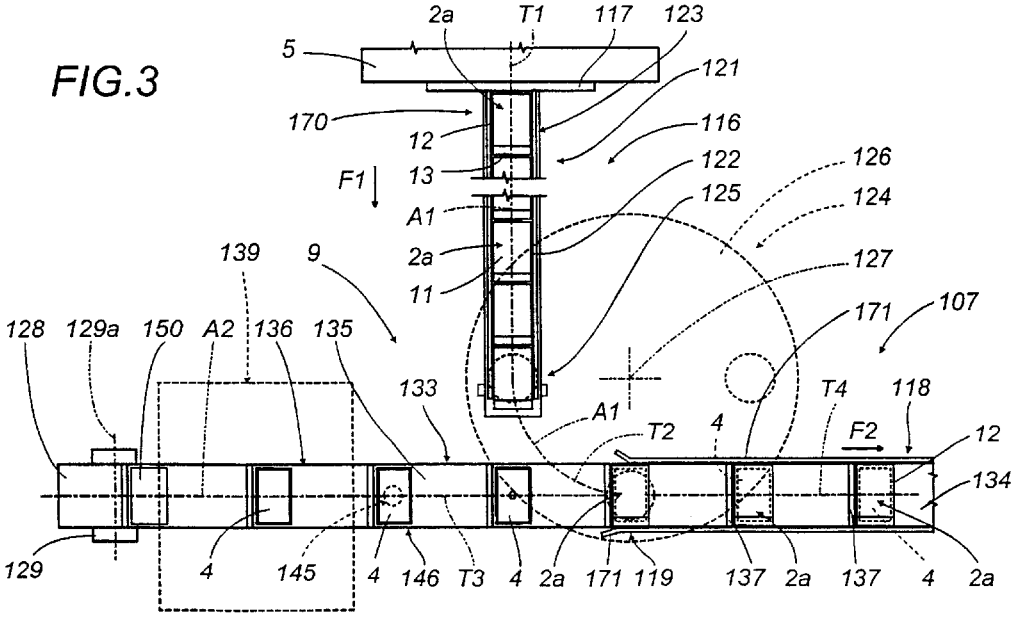
FIG. 3 is a fragmentary plan view of the system in FIG. 1, illustrated schematically and with parts omitted for clarity.

Referring to FIGS. 1 and 3, the transfer unit 107 comprises a first conveyor device 116 connected to an outfeed 117 (FIG. 3) of the packaging machine 5, and a second conveyor device 118 interconnecting an outfeed 119 of the first conveyor device 116 and an infeed 120 (FIG. 1) of the cellophaner 6.

As discernible in FIG. 3, packets 2*a* are carried by the first conveyor device 116 from the outfeed 117 of the packaging machine 5 to the outfeed 119 of the selfsame device 116, along a substantially horizontal conveying path A1.

The device 116 in question comprises a conveyor 121 consisting of a belt 122 looped around pulleys (one only of which is visible in FIGS. 1 and 3) rotatable continuously about respective horizontal axes and combining thus with the belt 122 to establish a top conveying branch 123. The branch 123 coincides with an initial rectilinear and horizontal section T1 of the conveying path A1 along which the packets 2*a* advance in a feed direction F1 extending at right angles to their end faces 13, each with the front main face 11 directed downwards and resting on the belt 122.

The device 116 further comprises a mechanism 124 located at a runout end 125 of the conveyor 121, by which the packets 2*a* are picked up and transferred. The function of the mechanism 124 is to take up the packets 2*a* singly and in succession from the runout end 125 and, maintaining their position in space, transfer them along a curved terminal section T2 of the path A1 (FIG. 3) toward the outfeed 119.

The pickup and transfer mechanism 124 illustrated is of the type disclosed in U.S. Pat. No. 4,883,163 and therefore conventional in embodiment, comprising a pickup and transfer head 126 rotatable continuously in an anticlockwise direction, as seen in FIG. 3, about a vertical axis denoted 127. The head 126 is as described and illustrated in U.S. Pat. No. 4,883,163 and affords a plurality of gripper elements 126*a* (FIG. 1) equispaced about the axis 127 and designed each to advance one packet 2*a* along the terminal section T2 toward the outfeed 119 (see FIG. 1).

The second conveyor device 118 comprises a belt 128 looped around pulleys 129, 130, 131 and 132 that are rotatable continuously about corresponding horizontal and mutually parallel axes 129*a*, 130*a*, 131*a* and 132*a* and combine thus with the belt 128 to create a top conveying branch 133. The branch 133 extends along a predetermined conveying path A2 and serves to advance the packets 2*a* in a direction at right angles to their flank faces 12, each with the front main face 11 directed downwards and resting on the belt 126. More exactly, the path A2 extends through the outfeed 119 in a direction normal to the initial section T1 and substantially tangential to the terminal section T2 at the outfeed 119.

As discernible from FIG. 1, the branch 133 extends between the pulleys denoted 129 and 131, passing over the pulley denoted 130 which is positioned to coincide with the outfeed 119. Two pulleys 130 and 131 are disposed at the same height and combine to establish a horizontal portion 134 of the conveying branch 133 that connects with the infeed 120 of the cellophaner 6 at a point coinciding with the pulley denoted 131, whilst the pulley denoted 129 is set at a height lower than that of the intermediate pulley 130 and combines with this same pulley to create an ascending portion 135 of the branch 133 extending along a feed direction denoted F2.

The ascending portion 135 of the branch 133 will be seen to coincide with a section of the conveying path A2 denoted T3 that converges with the curved terminal section T2 at the outfeed 119 along the aforementioned feed direction F2.

In like manner, the horizontal portion 134 of the branch 133 coincides with a section T4 of the path onto which the terminal section T2 converges at the outfeed 119 along the same feed direction F2.

The belt 128 presents a succession of pockets 136 distributed uniformly along its length at a given pitch k1. Each pocket 136 is compassed in the conveying direction of the belt 128 by a pair of relative slats 137 disposed transversely to the developable longitudinal axis of the loop and spaced apart at distance greater than that which separates the flank faces 12 of the packet 2*a*.

The device 9 for applying coupons 4 comprises a feed drum 138 by which each coupon 4 is directed into a respective pocket 136 of the belt 128 at a feed station 139 located along the section of the conveying path A2 denoted T3. The feed drum 138 is located above the conveying branch 133, rotatable anticlockwise (as viewed in FIG. 1) about a relative axis 138*a* parallel to the axes 129*a*, 130*a*, 131*a* and 132*a* of the pulleys, and tangential to a transfer drum 140 rotatable clockwise (as viewed in FIG. 1) about an axis 140*a* parallel to the axis 138*a* of the feed drum 138 and occupying a position of close proximity to a device 141 by which the coupons are extracted from a magazine 142. The coupons 4 are retained pneumatically by the drums 138 and 140 on respective cylindrical surfaces of revolution 143 and 144 each affording a plurality of suction ports (not illustrated) uniformly distributed about the corresponding axis 138*a* and 140*a* of rotation and connecting (in a conventional manner not indicated) to a source of negative pressure (conventional in embodiment and not indicated).

The device 9 further comprises a spray type gum dispenser 145 of conventional embodiment positioned at a gumming station 146 located along the relative section T3 of the path A2, interposed between the feed station 139 and the outfeed 119, by which an adhesive substance is applied directly to each of the coupons 4 in turn.

Figure 4:
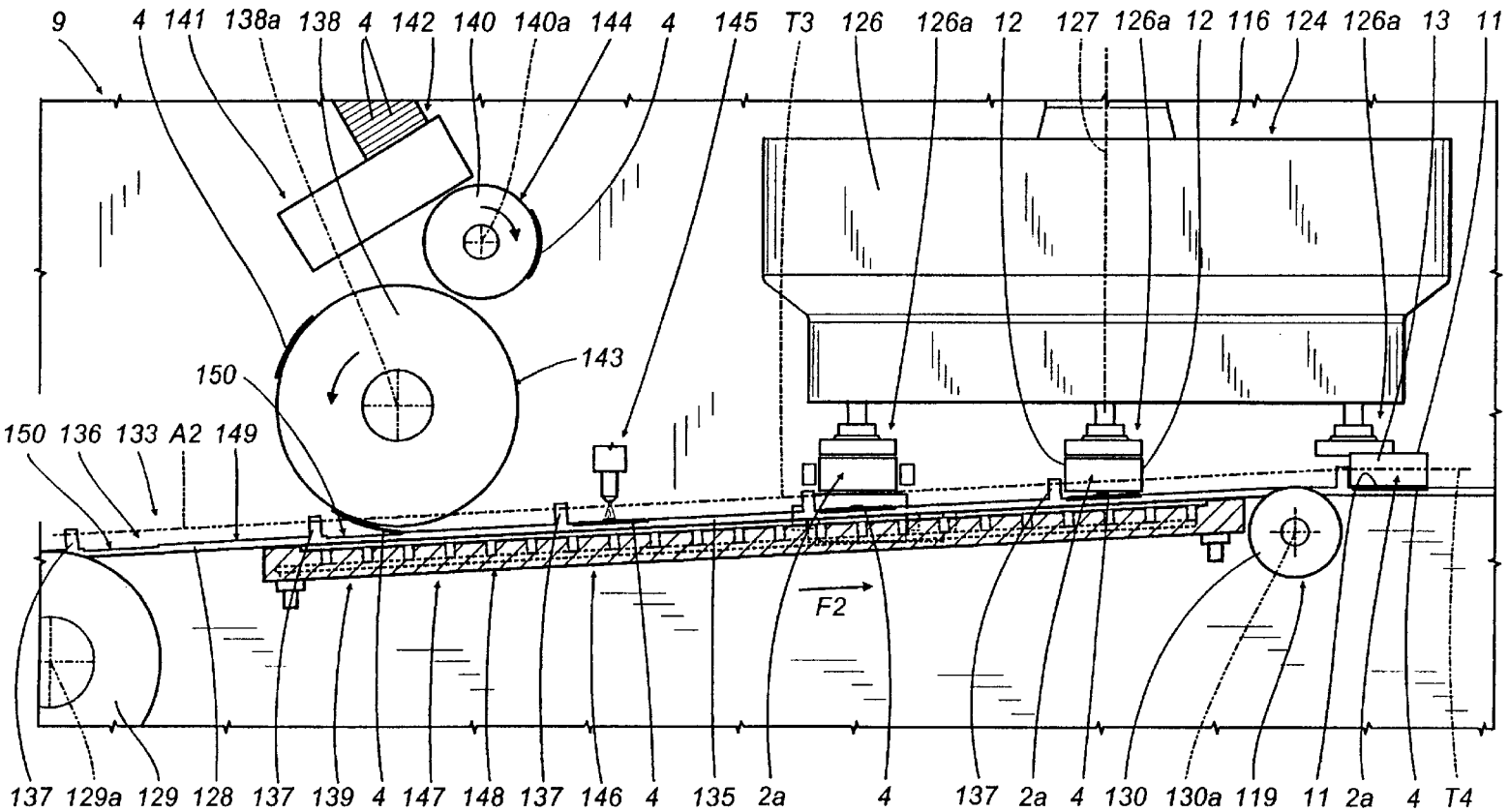
FIG. 4 illustrates a detail of the system in FIG. 1, viewed schematically in a side elevation with parts omitted for clarity.

The single coupons 4 are retained in a stable and predetermined position within the corresponding pockets 136 of the belt by a suction device 147 extending between the feed station 139 and the outfeed 119. As discernable to advantage in FIG. 4, the suction device 147 comprises a manifold 148 connected to a source of negative pressure not illustrated in the drawings, being conventional in embodiment. The manifold 148 is positioned below the ascending portion 135 of the belt 128, the belt in turn affording a plurality of through holes (not illustrated) by which the pockets 136 are caused to communicate with the manifold 148 as they advance between the feed station 139 and the outfeed 119. In particular, each pocket 136 presents a lowered portion coinciding with the bottom face 149 and establishing a relative suction port 150, which is proportioned to accommodate a respective coupon 4 and located near to the slat 137 located across the rear of the pocket 136, considered in relation to the feed direction F2.

The device 8 for applying the stamps 3 comprises an applicator drum 151 by which the single stamp 3 is affixed to the rear main face 11 of the respective packet 2*a* at a station 152 located on the section denoted T4. The drum 151 occupies a position above the conveying branch 133, rotatable anticlockwise (as viewed in FIG. 1) about an axis 151*a* parallel to the axes 129*a*, 130*a*, 131*a* and 132*a* of the pulleys, and substantially tangential to a transfer drum 153 rotatable clockwise (as viewed in FIG. 1) about a relative axis 153*a* parallel to the axis 151*a* of the applicator drum 151, positioned to coincide with a device 154 by which the stamps 3 are extracted from a magazine 155. The single stamps 3 are retained by the drums 151 and 153 pneumatically on respective cylindrical surfaces of revolution 156 and 157 each with a plurality of suction ports (not illustrated) uniformly distributed about the relative axis 151*a* and 153*a* of rotation and connected (in conventional manner, not illustrated) to a source of negative pressure (conventional, and not illustrated).

The device 8 further comprises a spray type gum dispenser 158 of conventional embodiment positioned at a gumming station 159 located along the relative section T4 of the path and preceding the affixing station 152 in the conveying direction F2, by which an adhesive substance is applied directly to each packet 2*a* in turn.

The cellophaner 6 comprises a wrapping wheel 160 rotatable anticlockwise (as viewed in FIG. 1) about an axis 160*a* parallel to the axes 129*a*, 130*a*, 131*a* and 132*a* of the pulleys; the wheel 160 presents a plurality of peripheral pockets 161 each exhibiting two mutually opposed and parallel side walls 162 and a bottom wall 163, and proportioned to admit a respective packet 2*a*, 102 of cigarettes.

The cellophaner 6 also comprises a support 164 for rolls 165 of continuous strip transparent wrapping material 166, and a relative decoiling and cutting device 167 by which single wrapping sheets 15 are separated from the strip 166 in conventional manner (not illustrated).

The cellophaner 6 further comprises a device 168 by which the sheets 15 are supplied to the infeed 120 and positioned in such a way that each one will be intercepted by a corresponding packet 2*a* prior to entering the relative pocket 161. Accordingly, the infeed 120 of the cellophaner 6 coincides with a folding station 169 at which each single sheet 15 is bent to a U profile over one flank face 12 and over the two main faces 11 of a relative packet 2*a*.

Finally, the cellophaner 6 comprises a succession of additional folding stations (conventional and therefore not illustrated) at which the flaps of the sheets 15 are flattened, and a succession of stations (likewise conventional and therefore not illustrated) at which the flaps are heat sealed to complete the manufacture of the sealed packets 102.

In operation of the system 101, packets 2*a* emerge from the outfeed 117 of the packaging machine 5 in a continuous single file 170 and are carried along the initial section T1 of the conveying path A1 by the relative conveyor 121, advancing continuously and in close order, each positioned with the main front face 11 directed downwards and resting on the conveying branch 123 of the relative belt 122.

As each packet 2*a* arrives at the runout end 125 of the conveyor 121, it is taken up by the pickup and transfer mechanism 124 and carried continuously by a respective gripper element 126*a* along the curved section T2 of the path A1 toward the outfeed 119 of the first conveyor device 116, then released into a pocket 136 of the second conveyor device 118 with the front face 11 directed downwards and resting on the relative conveying branch 133.

The conveyor device 118 and the pickup and transfer mechanism 124 are synchronized in operation so that each successive pocket 136 reaches the outfeed 119 simultaneously with a respective packet 2*a*.

On arrival at the outfeed 119, the position of the packet 2*a* relative to the conveying branch 133 is promptly stabilized by interaction with the rear slat 137 of the pocket 136 and with a pair of guide rails 171 flanking the horizontal portion 134 of the branch 133 on either side and extending forward along the feed direction F2 from the outfeed 119 of the first conveyor device 116.

As the conveying branch 133 advances through the feed station 139, a coupon 4 is released from the drum 138 into the suction port 150 afforded by each pocket 136.

More exactly, the coupons 4 are removed singly and in succession by the extraction device 141 from an opening at the bottom of the magazine 142, in which they are stacked, and offered each in turn to the cylindrical surface 144 of the transfer drum 140. The coupon 4 is then taken up from the device 141 onto the drum 140 by means of the suction ports (not illustrated), transferred to the suction ports (not illustrated) of the feed drum 138, and finally released onto the suction port 150 of a respective pocket 136.

The suction ports (not illustrated) of the feed drum 138 are spaced apart at the same pitch k1 as the pockets 136 and activated synchronously with the belt 128, in such a way that each coupon 4 is released directly onto a relative port 150.

Thereafter, as the ports 150 advance through the gumming station 146, the upwardly directed face of each respective coupon 4 receives a given quantity of the adhesive substance from the dispenser 145.

The sections T2 and T3 of the conveying paths A1 and A2 converge toward the outfeed 119 in such a way that each coupon 4 and the respective packet 2*a* are brought into contact only after the packet has assumed a stable transverse position internally of the pocket 136, thereby precluding the risk that the coupon 4 could stick to the packet incorrectly positioned.

The single packets 2*a* with the associated coupons 4 are then advanced by the conveying branch 133 along the section denoted T4 through the second gumming station. 159 and thereafter through the station 152 at which a revenue stamp 3 is affixed to each one by the applicator drum 151.

More exactly, the stamps 3 are removed singly and in succession by the extraction device 154 from an opening at the bottom of the magazine 155, in which they are stacked, and offered each in turn to the cylindrical surface 157 of the transfer drum 153. The stamp 3 is then taken up from the device 154 onto the drum 153 by means of the suction ports (not illustrated), transferred to the suction ports (not illustrated) of the applicator drum 151, and finally affixed to the rear main face 11 of the relative packet 2*a* along the line of the hinge 14*c*.

The suction ports (not indicated) of the applicator drum 151 are spaced apart at the same pitch k1 as the pockets 136 and activated synchronously with the belt 128, n such a way that each stamp 3 is affixed directly to a relative packet 2*a*.

Once beyond the station 152, the packets 2*a* advance toward the infeed 120 of the cellophaner 6, their movement timed with that of the pockets 161 indexed by the wrapping wheel 160.

A sheet 15 of wrapping material is supplied to the folding station 169, i.e. directed into the area between the horizontal portion 134 of the conveying branch 133 and the periphery of the wheel 160, and retained in a position disposed transversely to the feed direction F2. The wheel 160 is indexed in such way that each successive pocket 161 will pause in alignment with the station 169. During each pause, a packet 2*a* complete with stamp 3 and coupon 4 is directed into the waiting pocket 161. Moving toward the wheel, the packet 2*a* impinges on the sheet 15 of wrapping material, which is thus forced into the pocket 161 and bent initially to a U profile around the packet. Thereafter, the packet 2*a* is carried by the wheel 160 together with the relative sheet 15 in conventional manner through a series of folding stations (not illustrated), then through a series of sealing stations (not illustrated), from which the sealed packet 102 of cigarettes will ultimately emerge as illustrated in FIGS. 2*a* and 2*b*.

Figure 5:
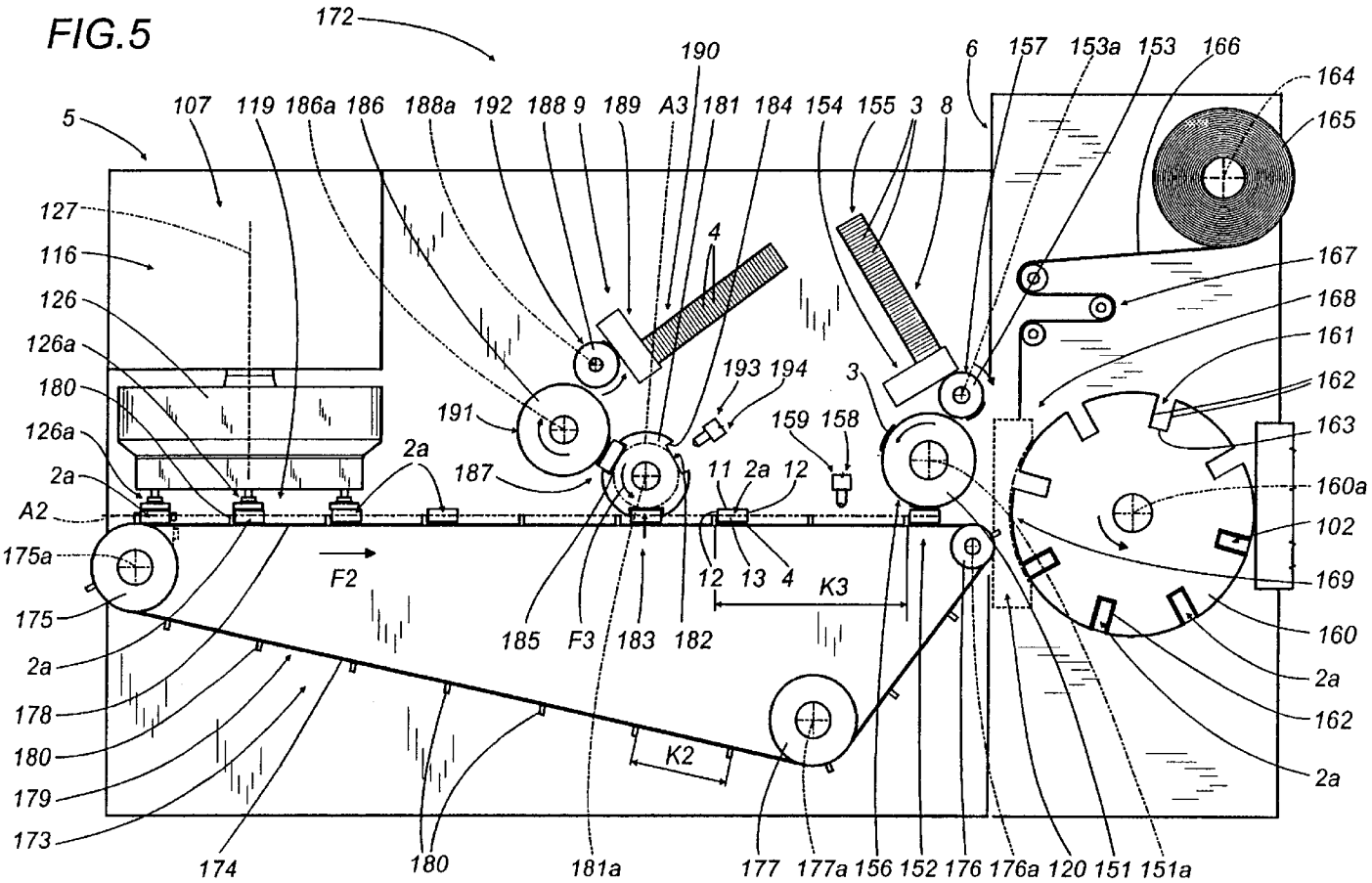
FIG. 5 shows the system of FIG. 1 in an alternative is solution, viewed schematically in a side elevation with parts omitted for clarity and illustrating a given moment during operation.

FIG. 5 illustrates a system 172 designed similarly to manufacture sealed packets 102 of cigarettes as produced with the system 101 described previously. This system 172 is a variation in embodiment of the system 101 described thus far, and accordingly the same reference numbers will continue to be used in the description wherever feasible.

In this system 172, the second conveyor device 118 illustrated in FIG. 1 is replaced by a conveyor device 173 of different embodiment that extends between the outfeed 119 of the first device 116 and the infeed 120 of the cellophaner 6.

The device 173 comprises a belt 174 looped over pulleys 175, 176, and 177 rotatable continuously about respective axes 175*a*, 176*a* and 177*a* lying parallel one with another and with the axis 160*a* of the wheel 160, and combining to create an upwardly directed horizontal conveying branch 178 in the belt 174. The conveying branch 178 extends along a predetermined conveying path A2 and serves to carry the packets 2*a* along a direction normal to their flank faces 12, each with the front main face 11 directed downwards and resting on the belt 174. More exactly, the conveying path A2 interconnects the outfeed 119 of the first conveyor device 116 and the infeed 120 of the cellophaner 6, running in a predetermined feed direction F2 followed by the conveying branch 178, which extends perpendicular to the initial section T1 (not shown in FIG. 5) and substantially tangential to the terminal section T2 (likewise not shown in FIG. 5) at the outfeed 119 of the first device 116.

The belt 174 presents a succession of pockets 179 distributed uniformly along its length at a given pitch denoted k2. Each pocket 179 is compassed in the conveying direction of the belt 174 by a pair of respective slats 180 disposed transversely to the developable longitudinal axis of the loop and spaced apart at distance greater than that which separates the flank faces 12 of the packet 2*a*.

The device 9 which applies the coupons 4 comprises a wheel 181 with pockets, positioned above the conveying branch 178 beyond the outfeed 119 of the first conveyor device 116, considered in the feed direction F2, and is rotatable about an axis 181*a* parallel to the axes 175*a* 176*a* and 177*a* of the pulleys. The wheel 181 in the example illustrated presents three pockets 182, uniformly distributed about its periphery, and is power driven in such a manner that the pockets 182 will rotate about the axis 181*a* in an anticlockwise direction F3, as viewed in FIG. 5, describing a circular path A3 and revolving tangentially to the path denoted A2 at a station 183 where the packets 2*a* are first picked up from the conveying path A2 and then released back onto the selfsame path A2.

Each pocket 182 presents two mutually opposed and parallel sides 184 and a bottom 185 set at right angles to the sides 184, and is proportioned to accommodate a respective packet 2*a* disposed with the rear main face 11 offered to the bottom 185 and the flank faces 12 offered to the sides 184. The single pockets 182 are connected to a source of negative pressure (conventional in embodiment and therefore not illustrated) in such a manner that the packet 2*a* can be retained pneumatically while passing along the circular path A3.

The device 9 further comprises a drum 186 by which the coupons 4 are applied each to the front main face 11 of a respective packet 2*a* at a station 187 located along the circular path A3. The drum 186 is rotatable (clockwise as viewed in FIG. 5) about an axis 186*a* extending parallel to the axis 181*a* of the wheel 181 and revolves substantially tangential to a transfer drum 188 rotatable anticlockwise (as viewed in FIG. 5) about an axis 188*a* parallel to the axis 186*a* of the applicator drum 186, in a position close to a device 189 by which the coupons 4 are extracted from a magazine 190. The coupons 4 are retained pneumatically by the drums 186 and 188 on respective cylindrical surfaces of revolution 191 and 192 each affording a plurality of suction ports (not illustrated) uniformly distributed about the axis 186*a* and 188*a* of rotation and connected (in a conventional manner not illustrated) to a source of negative pressure (conventional in embodiment and not illustrated).

The device 9 further comprises a spray type gum dispenser 193 of conventional embodiment positioned at a gumming station 194 located along the circular path A3 in the feed direction F3 between the pickup station 183 and the affixing station 187, by which an adhesive substance is applied directly to the front main face 11 of each packet 2*a*.

The system 172 of FIG. 5 also comprises a device 8 for affixing revenue stamps 3, located beyond the coupon device 9 relative to the feed direction F2 and identical to that already described for the system 101 of FIG. 1.

In operation of the system 172, packets 2*a* emerging from the outfeed 117 of the packaging machine 5 are taken toward the outfeed 119 of the first conveyor device 116 in the manner already described for the system 101 of FIG. 1.

On reaching the outfeed 119, each packet 2*a* in turn is released into a corresponding pocket 179 of the second conveyor device 173 with the front face 11 directed downwards and resting on the conveying branch 178 of the relative belt 174.

The operating cycles of the conveyor device 173 and the pickup and transfer mechanism 124 are timed so that the pockets 179 arrive at the outfeed 119 of the first device simultaneously with the packets 2*a* but at twice the frequency. In other words, the packets 2*a* are placed on the conveying branch 178 spaced apart at a pitch k3 twice the pitch k2 of the pockets 179.

As a packet 2*a* reaches the pickup station 183, it is lifted from the conveying path A2 by a relative pocket 182 of the wheel 181.

Retained by suction internally of the pocket 182 with the rear main face 11 against the bottom 185, the packet 2*a* is made to advance along the circular path A3 in the direction denoted F3.

The packet 2*a* is directed in succession through the gumming station 194, where the adhesive substance is applied by the dispenser 193 to the front main face 11, and the application station 187 where a coupon 4 is released onto the gummed face 11 by the applicator drum 186.

The single coupon 4 is supplied to the station 187 in identical fashion to that described previously for the system 101 of FIG. 1. That is to say, the coupons 4 are removed singly and in succession by the extraction device 189 from an opening at the bottom of the magazine 190, internally of which they are stacked, and offered each in turn to the cylindrical surface 192 of the transfer drum 188. The coupon 4 is then taken up from the device 189 onto the drum 188 by means of the suction ports (not illustrated), transferred to the suction ports (not illustrated) of the feed drum 186, and finally released to the application station 187 and fixed to the packet 2*a*.

The suction ports (not illustrated) of the feed drum 186 are spaced apart at the same pitch k3 as that of the packets 2*a* and activated synchronously with the passage of the pockets 179, in such a way that each coupon 4 is applied to the front main face 11 of a relative packet 2*a*.

Having passed through the application station 187 the packet 2*a* advances further along the circular path A3 to the point ultimately of regaining the pickup station 183, where it is released back onto the conveyor device 173 with the coupon interposed between the front main face 11 and the conveying branch 178.

The pockets 182 of the wheel 181 are distributed around the periphery at the same pitch k32 as that of the pockets 179 afforded by the belt 174, and advanced along the circular path A3 timed in such a way that each passes through the pickup station 183 simultaneously with one of the pockets 179. During the interval of time taken for a packet 2*a* to cover the entire circular path A3 starting and finishing at the pickup station 183, the conveying branch 178 of the belt 174 will direct three pockets 179 along the relative path A2 and in the corresponding feed direction F2, thus positioning an empty pocket 179 at the station 183 as the aforementioned interval of time is completed. In short, as the pockets 179 advance through the pickup station 183, those that are empty will receive a packet 2*a* with a coupon 4 newly attached, whilst those that are occupied will be emptied as the relative packets 2*a* are diverted onto the circular path A3.

Figure 6:
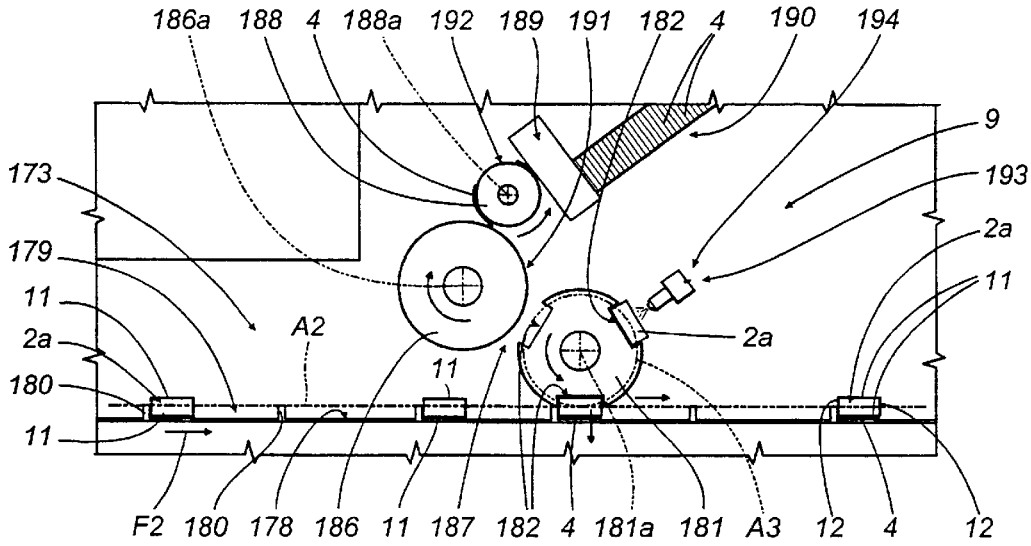
FIG. 6 illustrates a detail of the system in FIG. 5, viewed schematically in a side elevation with parts omitted for clarity and illustrating a successive moment during operation.

FIG. 6 illustrates the device 9 for applying the coupons.4 at a moment in the operating cycle soon after that illustrated in FIG. 5. More exactly, the packet 2*a* that occupies the gumming station 194 in FIG. 6 is the same packet that occupies the pickup station 183 in FIG. 5, whilst the packet occupying the pickup station 183 in FIG. 6 is the packet 2*a* occupying the application station 187 in FIG. 5.

The single packets 2*a* with the associated coupons.4 are advanced by the conveying branch 178 along the relative path A2 through the gumming station 159 and then through the station 152 at which a revenue stamp 3 is affixed to each one by the applicator drum 151, in the same manner as described already for the system 101 of FIG. 1.

Once beyond the station 152, the packets 2*a* advance toward the infeed 120 of the cellophaner 6, their movement timed with that of the pockets 161 indexed by the wrapping wheel 160.

Finally, the cellophaner 6 will perform the usual sequence of steps involved in producing a sealed packet 102 of cigarettes in the same manner as described already for the system 101 of FIG. 1.

In the first system 101 and the second system 172 alike, the step of applying the coupon 4 precedes the step of affixing a revenue stamp 3; nonetheless these steps might be swapped about, in accordance with the present invention, adopting variations in embodiment that are obvious and not illustrated for either system 101 or 172.

It is also significant that, whilst the portion 11*a* of the front face 11 of each packet 2*a* represents a relatively small percentage of the face 11 overall, it could be printed with emblems or decoration (not illustrated) and/or messages (not illustrated) of whatever nature addressed to the consumer.

Alternatively, in another possible embodiment (not illustrated) of the packet 2*a* shown in FIGS. 2*a* and 2*b*, the front face 11 might be covered completely by the respective coupon 4. In this instance the transverse dimensions of the coupon 4 would be the same as those exhibited by the front face 11 of the packet.

What is claimed is:

1. A method for manufacturing sealed packets of cigarettes with revenue stamps and coupons comprising:

fashioning packets of cigarettes, in a packaging machine, each delimited by an outer surface that comprises a wrapping material;

conveying the packets of cigarettes from the packaging machine to a cellophaner with a transfer means;

enveloping each packet of cigarettes in a transparent overwrapping material and securing the material to complete the sealed packet; and applying a respective revenue stamp and applying a respective coupon to the outer surface of each packet during the step of conveying the packets of cigarettes from the packaging machine to the cellophaner, wherein the outer surface presents two mutually opposed and parallel main faces, the respective coupon being applied to a first of the two main faces and the respective revenue stamp being applied to a second of the two main faces.

2. A method as in claim 1, wherein the outer surface also two mutually opposed and parallel flank faces and two mutually opposed and parallel end faces.

3. A method as in claim 1, wherein the transverse dimensions of the single coupon and the transverse dimensions of the first main face are substantially identical.

4. A method as in claim 3 wherein the coupon is proportioned to cover the entire expanse of the first main face except for a predetermined portion of the selfsame main face.

5. A method as in claim 1, wherein the step of conveying the packets with the transfer means comprises the subsidiary steps of advancing the packets along a first predetermined path with a first conveyor means and advancing the packets along a second predetermined path, connected to the first path, with a second conveyor means combining with the first conveyor means to create the transfer means in such a way that the packets advance along the second path with the first main face directed toward the second conveyor means.

6. A method for manufacturing sealed packets of cigarettes with revenue stamps and coupons, comprising:

fashioning packets of cigarettes, in a packaging machine, each delimited by an outer surface that comprises a wrapping material;

conveying the packets of cigarettes from the packaging machine to a cellophaner with a transfer means;

enveloping each packet of cigarettes in a transparent overwrapping material and securing the material to complete the sealed packet; and applying a respective revenue stamp and applying a respective coupon to the outer surface of each packet during the step of conveying the packets of cigarettes from the packaging machine to the cellophaner, wherein the outer surface presents two mutually opposed and parallel main faces, two mutually opposed and parallel flank faces, and two mutually opposed and parallel end faces, and the coupon is applied to a first of the two main faces, wherein the step of conveying the packets with transfer means comprises the subsidiary steps of advancing the packets along a first predetermined path with first conveyor means and advancing the packets along a second predetermined path, connected to the first path with a second conveyor means combining with the first conveyor means to create the transfer means, in such a way that the packets advance along the second path with the first main face directed toward the second conveyor means and wherein the step of applying the coupon comprises the subsidiary steps of feeding the coupon to the second conveyor means, gumming at least a part of one face of the single coupon destined to come into contact with the packet, and directing the packets onto the second conveyor means with the first conveyor means in such a way that each packet is paired with a respective coupon.

7. A method for manufacturing sealed packets of cigarettes with revenue stamps and coupons, comprising:

fashioning packets of cigarettes, in a packaging machine, each delimited by an outer surface that comprises a wrapping material;

conveying the packets of cigarettes from the packaging machine to a cellophaner with a transfer means;

enveloping each packet of cigarettes in a transparent overwrapping material and securing the material to complete the sealed packet; and applying a respective revenue stamp and applying a respective coupon to the outer surface of each packet during the step of conveying the packets of cigarettes from the packaging machine to the cellophaner, wherein the outer surface presents two mutually opposed and parallel main faces two mutually opposed and parallel flank faces, and two mutually opposed and parallel end face, and the coupon is applied to a first of the two main faces, wherein the step of conveying the packets with the transfer means comprises the subsidiary steps of advancing the packets along a first predetermined path with a first conveyor means and advancing the packets along a second predetermined path, connected to the first path, with a second conveyor means combining with the first conveyor means to create the transfer means, in such a way that the packets advance along the second path with the first main face directed toward the second conveyor means and wherein the step of applying the coupon comprises the subsidiary steps of diverting the packets singly and in succession from the second conveyor means at a pickup station located along the second path, advancing each packet along a third predetermined path and through a station at which the coupons are applied, in such a way as to associate the respective coupon with the first main face, and returning each packet to the second conveyor means at a release station located along the second path with the relative coupon interposed between the first main face and the selfsame second conveyor means.

8. A method as in claim 7, wherein the third path is a circular path substantially tangential to the second path, and the release station coincides with the pickup station.

9. A system for manufacturing sealed packets of cigarettes with revenue stamps and coupons, comprising;

a packaging machine on which to fashion packets of cigarettes delimited by an outer surface comprising a wrapping material, the outer surface presenting a first and a second mutually opposed and parallel main faces;

a cellophaner by which a transparent overwrapping material is folded around each packet of cigarettes and secured in such a way as to complete the sealed packet;

transfer means by which the packets of cigarettes are conveyed from the packaging machine to the cellophaner;

a device by which revenue stamps are applied to the packets of cigarettes; and a device by which coupons are applied to the packets of cigarettes, wherein the device for applying the revenue stamps and the device for applying the coupons are located along the transfer means, the device for applying revenue stamps applying the revenue stamps to the first main faces of the packets, the device for applying coupons applying the coupons to the second main faces of the packets.

10. A system as in claim 9, wherein the transfer means comprises first conveyor means by which the packets are advanced along a first predetermined path, and second conveyor means by which the packets are advanced along a second predetermined path (A2) connected to the first path.

11. A system for manufacturing sealed packets of cigarettes with revenue stamps and coupons, comprising:

a packaging machine on which to fashion packets of cigarettes delimited by an outer surface comprising a wrapping material;

a cellophaner by which a transparent overwrapping material is folded around each packet of cigarettes and secured in such a way as to complete the sealed packet;

transfer means by which the packets of cigarettes are conveyed from the packaging machine to the cellophaner;

a device by which revenue stamps are applied to the packets of cigarettes; and a device by which coupons are applied to the packets of cigarettes, wherein the device for applying the revenue stamps and the device for applying the coupons are located along the transfer means, wherein the transfer means comprises first conveyor means by which the packets are advanced along a first predetermined path, and second conveyor means by which the packets are advanced along a second predetermined path connected to the first path and wherein the second conveyor means comprises a conveyor belt establishing the second path, which coincides with a predetermined feed direction and comprises a first predetermined ascending section extending in the selfsame feed direction, and a second predetermined substantially horizontal section constituting a continuation of the first section, disposed in such a way that the first predetermined path and the first section converge along the feed direction.

12. A system as in claim 11, wherein the coupons are distributed and gummed respectively at a feed station and a gumming station located along the first section of the second conveying path.

13. A system as in claim 11, wherein the conveyor belt comprises a succession of uniformly distributed pockets, each constructed and arranged to accommodate a respective packet, of which the bottom face affords a seat designed constructed and arranged to accommodate one respective coupon.

14. A system for manufacturing sealed packets of cigarettes with revenue stamps and coupons, comprising:

a packaging machine on which to fashion packets of cigarettes delimited by an outer surface comprising a wrapping material;

a cellophaner by which a transparent overwrapping material is folded around each packet of cigarettes and secured in such a way as to complete the sealed packet;

transfer means by which the packets of cigarettes are conveyed from the packaging machine to the cellophaner;

a device by which revenue stamps are applied to the packets of cigarettes; and a device by which coupons are applied to the packets of cigarettes, wherein the device for applying the revenue stamps and the device for applying the coupons are located along the transfer means, wherein the transfer means comprises first conveyor means by which the packets are advanced along a first predetermined path and second conveyor means by which the packets are advanced along a second predetermined path connected to the first path and wherein the second conveyor means comprises a conveyor belt of which a conveying branch establishes the second path, further comprising third conveyor means by which the packets are diverted singly and in succession from the second path at a pickup station located along the selfsame path, advanced along a third predetermined path and though a station at which the coupons are applied, then returned with the relative coupon to the second conveyor means at a release station located along the second path.

15. A system as in claim 14, comprising third conveyor means embodied as a wheel comprising a plurality of peripheral pockets each constructed and arranged to accommodate a respective packet, wherein the third path is a circular path extending substantially tangential to the second path, and the release station coincides with the pickup station.

16. A system as in claim 15, wherein the conveyor belt comprises a succession of uniformly distributed pockets each constructed and arranged to accommodate a respective packet, and is synchronized in operation with the wheel of the third conveyor means, driven continuously and timed in such a way that the respective pockets are advanced simultaneously and in succession through the pickup and release station.

* * * * *